US008187528B2

(12) United States Patent
Mordue

(10) Patent No.: US 8,187,528 B2
(45) Date of Patent: May 29, 2012

(54) MOLTEN METAL POST ASSEMBLY

(75) Inventor: George Mordue, Ravenna, OH (US)

(73) Assignee: Pyrotek, Inc., Spokane, WA (US)

( * ) Notice: Subject to any disclaimer, the term of this patent is extended or adjusted under 35 U.S.C. 154(b) by 381 days.

(21) Appl. No.: 12/442,413

(22) PCT Filed: Sep. 21, 2007

(86) PCT No.: PCT/US2007/020532

§ 371 (c)(1),
(2), (4) Date: Mar. 23, 2009

(87) PCT Pub. No.: WO2008/073179

PCT Pub. Date: Jun. 19, 2008

(65) Prior Publication Data

US 2010/0084440 A1 Apr. 8, 2010

Related U.S. Application Data

(60) Provisional application No. 60/846,578, filed on Sep. 22, 2006.

(51) Int. Cl.
*B22D 41/00* (2006.01)

(52) U.S. Cl. ..... 266/239; 266/287

(58) Field of Classification Search ..... 266/239, 266/287; 417/423.15

See application file for complete search history.

(56) References Cited

U.S. PATENT DOCUMENTS

| | | | | |
|---|---|---|---|---|
| 5,558,505 | A | 9/1996 | Mordue | |
| 5,944,496 | A | 8/1999 | Cooper | |
| 6,451,247 | B1 | 9/2002 | Mordue | |
| 6,887,425 | B2 | 5/2005 | Mordue et al. | |
| 7,273,582 | B2 * | 9/2007 | Mordue et al. | 266/239 |

* cited by examiner

*Primary Examiner* — Scott Kastler
(74) *Attorney, Agent, or Firm* — Fay Sharpe LLP

(57) ABSTRACT

The present invention relates generally to an apparatus for degassing, submerging, agitating and pumping molten metal. More particularly, the present invention relates to a mechanical apparatus for moving or pumping molten metal such as aluminum, zinc or magnesium. Specifically, the present invention is related to a drive for such an apparatus in which a motor is positioned above a molten metal bath and rotates a vertical shaft. The lower end of the shaft drives an impeller or a rotor to impart motion to the molten metal.

15 Claims, 6 Drawing Sheets

MOLTEN METAL POST ASSEMBLY

This application claims priority from U.S. Provisional Patent Application No. 60/846,578 filed on Sep. 22, 2006 and PCT No. PCT/US2007/020532 filed on Sep. 21, 2007, the entire disclosures of which are hereby incorporated reference herein. U.S. Pat. No. 6,887,425 is additionally incorporated by reference herein.

BACKGROUND

The present invention relates generally to an apparatus for degassing, submerging, agitating and pumping molten metal. More particularly, the present invention relates to a mechanical apparatus for moving or pumping molten metal such as aluminum, zinc or magnesium. Specifically, the present invention is related to a drive for such an apparatus in which a motor is positioned above a molten metal bath and rotates a vertical shaft. The lower end of the shaft drives an impeller or a rotor to impart motion to the molten metal.

In the processing of molten metals, it is often necessary to pump molten metal from one place to another. When it is desired to remove metal from a vessel, a so-called transfer pump is used. When it is desired to circulate molten metal within a vessel, a so-called circulation pump is used. When it is desired to purify molten metal disposed within a vessel, a so-called gas injection pump is used. In each of these pumps, a rotatable impeller is submerged, typically within a pumping chamber, in the molten metal bath contained in the vessel. Additionally, the motor is suspended on a superstructure over the bath by posts connected to the base. In another embodiment of these pumps, a rotatable impeller can be submerged in the molten metal bath by a shaft affixed to a suspended motor, where the motor is not supported over the bath by any posts. Rotation of the impeller within the pumping chamber forces the molten metal as desired in a direction permitted by the pumping chamber design.

Mechanical pumps for moving molten metal in a bath historically have a relatively short life because of the destructive effects of the molten metal environment on the material used to construct the pump. Moreover, most materials capable of long term operation in a molten metal bath have relatively poor strength which can result in mechanical failure. In this regard, the industry has typically relied on graphite, a material with adequate strength, temperature resistance and chemical resistance, to function for an acceptable period of time in the harsh molten metal environment.

While graphite is currently the most commonly used material, it presents certain difficulties to pump manufacturers. Particularly, mechanical pumps usually require use of a graphite pump housing submerged in the molten metal. However, the housing is somewhat buoyant in the metal bath because the graphite has a lower density than the metal. In order to prevent the pump housing from rising in the metal and to prevent unwanted lateral movement of the base, a series of vertical legs are positioned between the pump housing and an overhead structure which acts simultaneously to support the drive motor and locate the base. In addition to functioning as the intermediate member in the above roles, the legs, or posts as they are also called, must be strong enough to withstand the tensile stress created during installation and removal of the pump in the molten metal bath.

Similarly, the shaft connecting the impeller and the motor is constructed of graphite. Often, this shaft component experiences significant stress when occluding matter in the metal bath is encountered and sometimes trapped against the housing. Since graphite does not possess as high of a strength as would be desired, it would be helpful to reinforce the leg and shaft components of the pump. A shaft or post assembly made entirely of ceramic would be brittle and subject to an unexpected failure. Furthermore, exposed metal components residing in the molten metal bath can dissolve.

In addition, graphite can be difficult to work with because graphite has different thermal expansion rates in its two grain orientations. This may result in a post and base having divergent and conflicting thermal expansion rates in the molten metal environment. This problem is compounded by the fact that pump construction has historically required cementing the graphite post into a hole in the graphite base. This design provides no tolerance between the components to accommodate this divergent thermal expansion. Unfortunately, this can lead to cracking of the base or the post. Accordingly, it would be desirable to have a molten metal pump wherein the mating of a post and a base is achieved in a manner which accommodates divergent thermal expansion tendencies.

Tensor pumps combine ceramic and steel with an improved design to increase reliability of molten metal pumps. Traditional graphite pumps must be rebuilt about three times per year when the graphite posts become oxidized or broken. By replacing the posts with a stronger material that will not oxidize, the life of the pump has been extended to up to a year. Fewer rebuilds mean lower costs and less labor to maintain pumps.

Tensor pumps are centered around a high temperature alloy steel rod loaded in tension. The tensor rods hold the ceramic posts in compression to maximize their strength. Fragile ceramic sleeves are no longer needed to protect graphite posts from oxidation and abrasion. Ceramic sleeves can also hide post oxidation which could result in unexpected failures. Not only are the ceramic posts stronger than graphite, if they do break, the base is still supported by the steel rods.

In addition, tensor pump bases are very strong. The holes in the base are much smaller which means that less material needs to be removed during manufacturing. The base, like the posts, is also loaded in compression for maximum strength, which can last up to a year between rebuilds and which replaces graphite posts with ceramic and steel.

Tensor pumps are also the most economical molten metal pumps available. With a reasonable initial cost, predictable parts usage, and low energy requirements, tensor pumps cost less to operate than other mechanical pumps. And when a pump does need maintenance, it can be pulled out of service and replaced with another pump quickly, minimizing the impact on production. When the pump finally does need to be rebuilt there are no structural cement joints, which is another advantage of tensor pumps. The pump is bolted together and it can actually be used right after assembly. Tensor pumps can be made as transfer, circulation, and gas injection pumps. Flows range from a minimum of 100 pounds (45 kg.) aluminum per minute to a maximum of 30,000 pounds (13.6 tons) per minute.

The prior art utilized a metal rod having a foot welded to the base and which would be trapped in the graphite base of the molten metal pump. The present invention. Instead of having to weld the foot onto the rod, there is now a keeper pair which is easily put into place at the groove of the rod. Then when the rod is pulled up, the two halves of the keeper pair catch and engage the retainer cup and work in the same way as the prior design.

BRIEF DESCRIPTION

According to one aspect of the present invention, a molten metal transfer pump is provided. The molten metal transfer pump includes a base assembly, a platform assembly, a motor positioned on the platform assembly and at least one post assembly. The platform assembly has an outlet and a pumping chamber. The pumping chamber further includes an impeller disposed. The post assembly is disposed between the base assembly and the platform assembly and includes a rod disposed within an inner member and an outer sheath. The rod includes a cap disposed within a cavity of the base assembly.

According to another aspect, a post assembly is disclosed for use with a molten metal transfer pump. The assembly includes a tensor rod, a retainer cup and a keeper pair. The retainer cup has a first side, a second side and an opening extending therethough. The first side includes a concave indentation and the second side includes a recess. The keeper pair comprises two mirror image halves and have a top side and a bottom side. The keeper pair is adapted to keep the rod in contact with said retainer cup.

According to yet another aspect, a method of forming a post assembly is disclosed for use with a molten metal transfer pump. The method includes providing a tensor rod having a first end and a second end, passing the tensor rod through a retainer cup having a first side and a second side, assembling a first half and a second half of a keeper pair around the tensor rod at the groove, sliding said retainer cup down said tensor rod until said recess engages said keeper pair; and engaging said rod assembly in a molten metal base of a molten metal transfer pump. The rod includes a groove toward the first end and the keeper pair is assembled around the groove.

DETAILED DESCRIPTION

Figure 1:
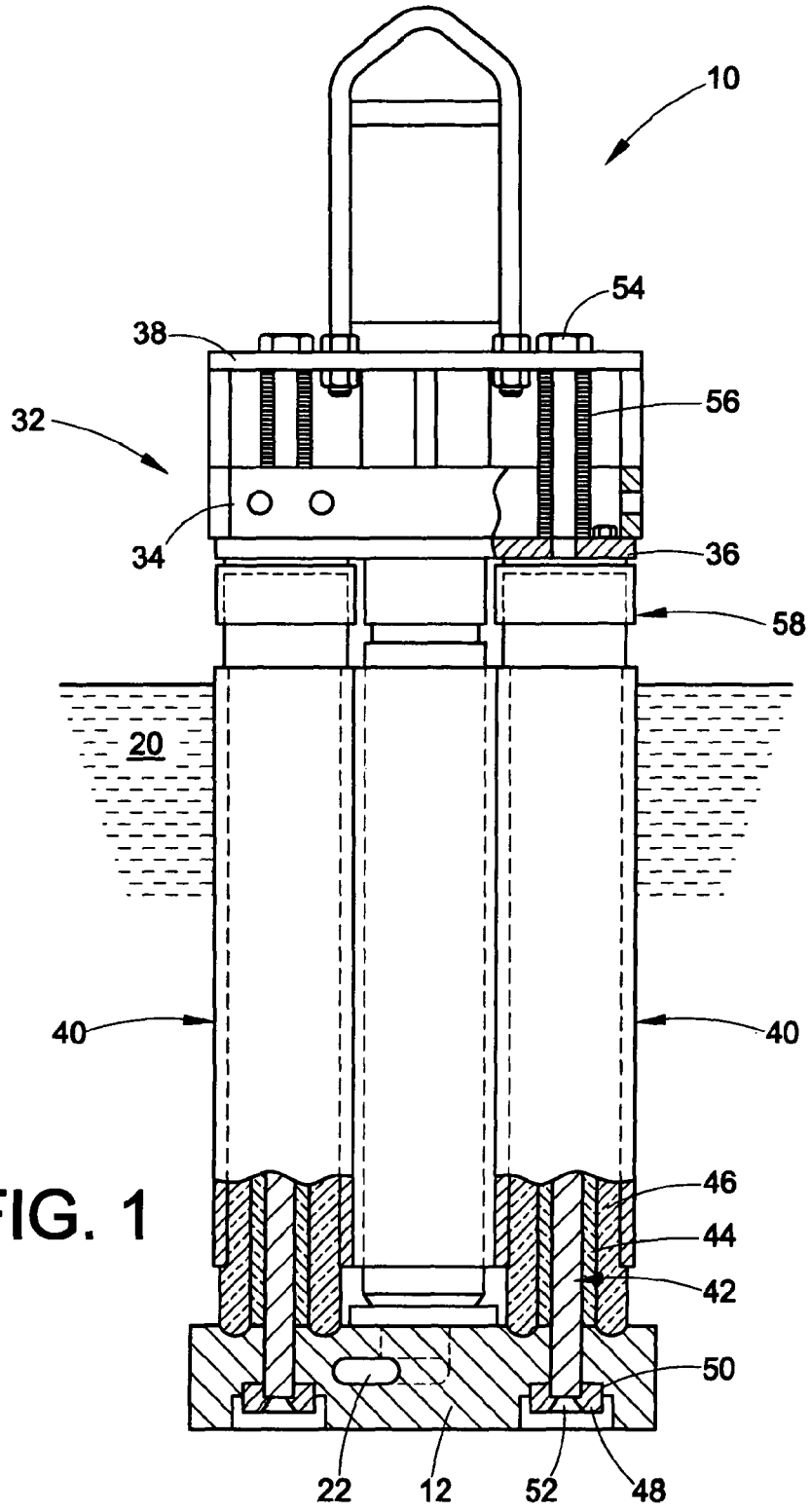
FIG. 1 is a front elevation view, partially in cross-section, of a molten metal pump.

Referring to FIG. 1, a molten metal transfer pump is provided. The molten metal pump 10 includes a base assembly 12 having a pumping chamber 14 with an impeller (not shown) disposed therein. Bearing rings 18 provide mating surfaces between the impeller and the base assembly 12. Rotation of the impeller forces molten metal 20 through outlet 22 and up riser tube (not shown) for transport to another location. Rotation of the impeller is achieved when motor (not shown) rotates shaft (not shown) by turning shaft coupling (not shown) provided therebetween. The motor (not shown) is positioned above the base assembly 12 on a platform assembly 32 having an insulation layer 34, a motor mount bracket 36 and a motor mount plate 38.

With further reference to FIG. 1, two post assemblies 40 are shown. However, any number of post assemblies could be used in the present invention, preferably one, two or four. Most preferably, two post assemblies 40, comprised of a rod 42 constructed of a heat resistant alloy material disposed within an inner member 44 and an outer sheath 46 suspend the base assembly 12 below the platform assembly 32. The inner member 44 is disposed between the rod 42 and the outer sheath 46. The inner member can be a material to wet out molten metal that may penetrate the outer sheath. The inner member can comprise fiberfrax, graphoil or other similar material, including but not limited to compressible ceramics. Preferably, the rod will be constructed of an alloy available from Metaullics Systems Co., L.P. 31935 Aurora Road, Solon, Ohio, 44139.

The outer sheath 46 includes a ceramic shield for additional protection against oxidation, erosion, corrosion, etc. The lower end of rod 42 includes cap 48. Cap 48 is disposed within a cavity 50 in base assembly 12. A graphite or refractory plug 52 is cemented into the lowermost portion of the cavity 50 to seal the area from molten metal. Plug 52 is such that its diameter is sufficiently large to include the rod 42 and both the inner member 44 and outer sheath 46, while still sealing the connection within the housing. The upper end of the rod 42 extends through the insulation layer 34 and is secured with nut 54 to motor mount plate 38. A disc spring 56 or other compression spring is disposed between the motor mount plate 38 and insulation layer 34. Preferably, an insulating washer (not shown) will be positioned between motor mount plate 38 and spring 56. Tightening of nut 54 results in compression of the spring 56 and a bias on the rod 42 and inner 44 and outer 46 sheaths.

This assembly provides a high strength alloy rod connection between the base and motor mount. The alloy rod 42 is further supported by steel alloy sleeve, which surrounds the alloy rod 42. In addition to the steel alloy sleeve, the assembly protects the otherwise degradable rod from the molten metal environment by surrounding the alloy rod and steel alloy sleeve with a ceramic post. A further advantage is that the thermal expansion mismatch resulting from divergent grain orientations in a graphite post and a graphite base is eliminated because a graphite post is not rigidly cemented into a hole in the base. Furthermore, the strength of the graphite sheath is increased because it is retained under compression as a result of being squeezed between socket 58 and the upper surface of base assembly 12.

Figure 2:
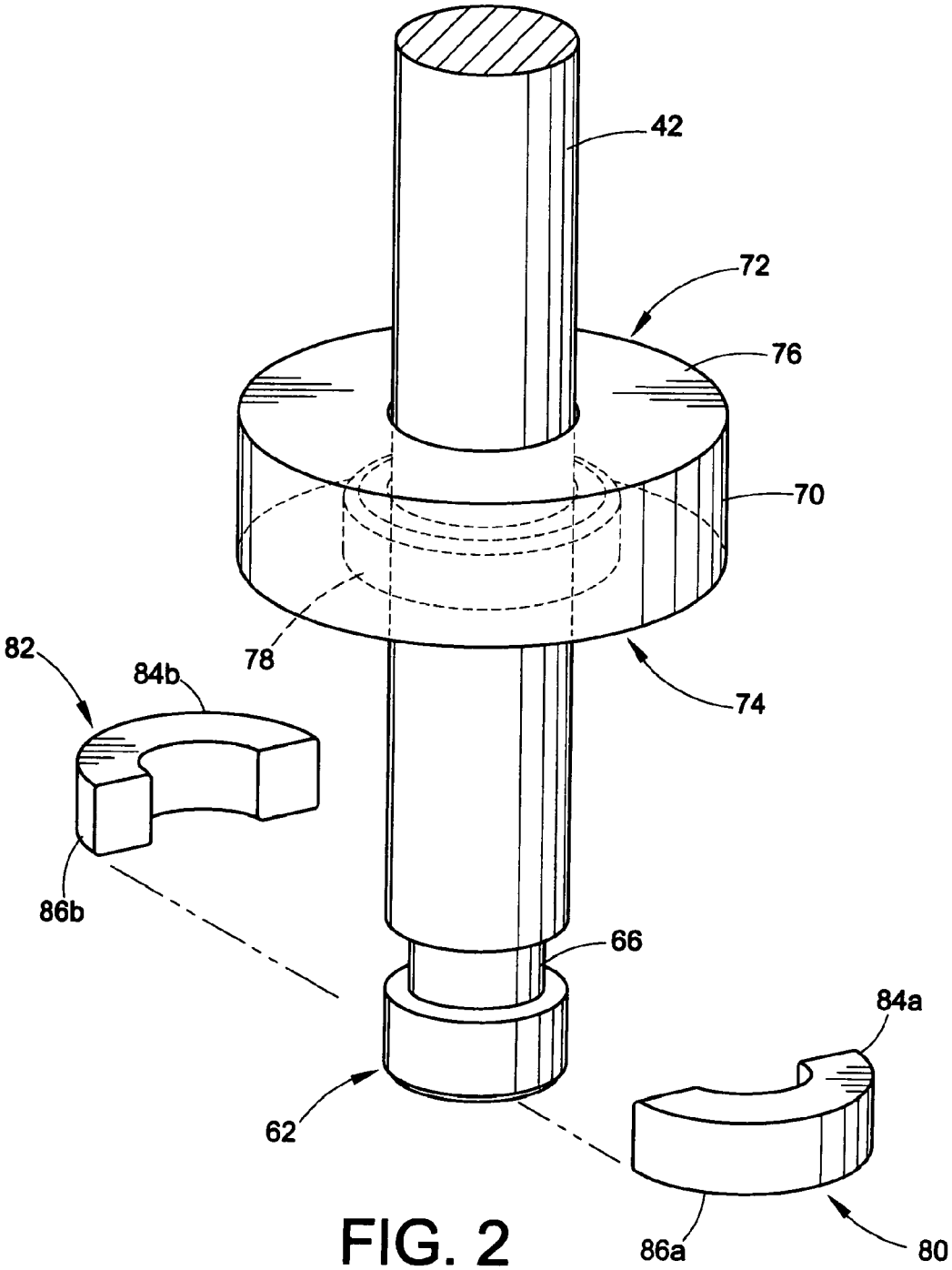
FIG. 2 is a perspective view of a tensor rod, retainer cup and keeper pair prior to assembly.
Figure 3:
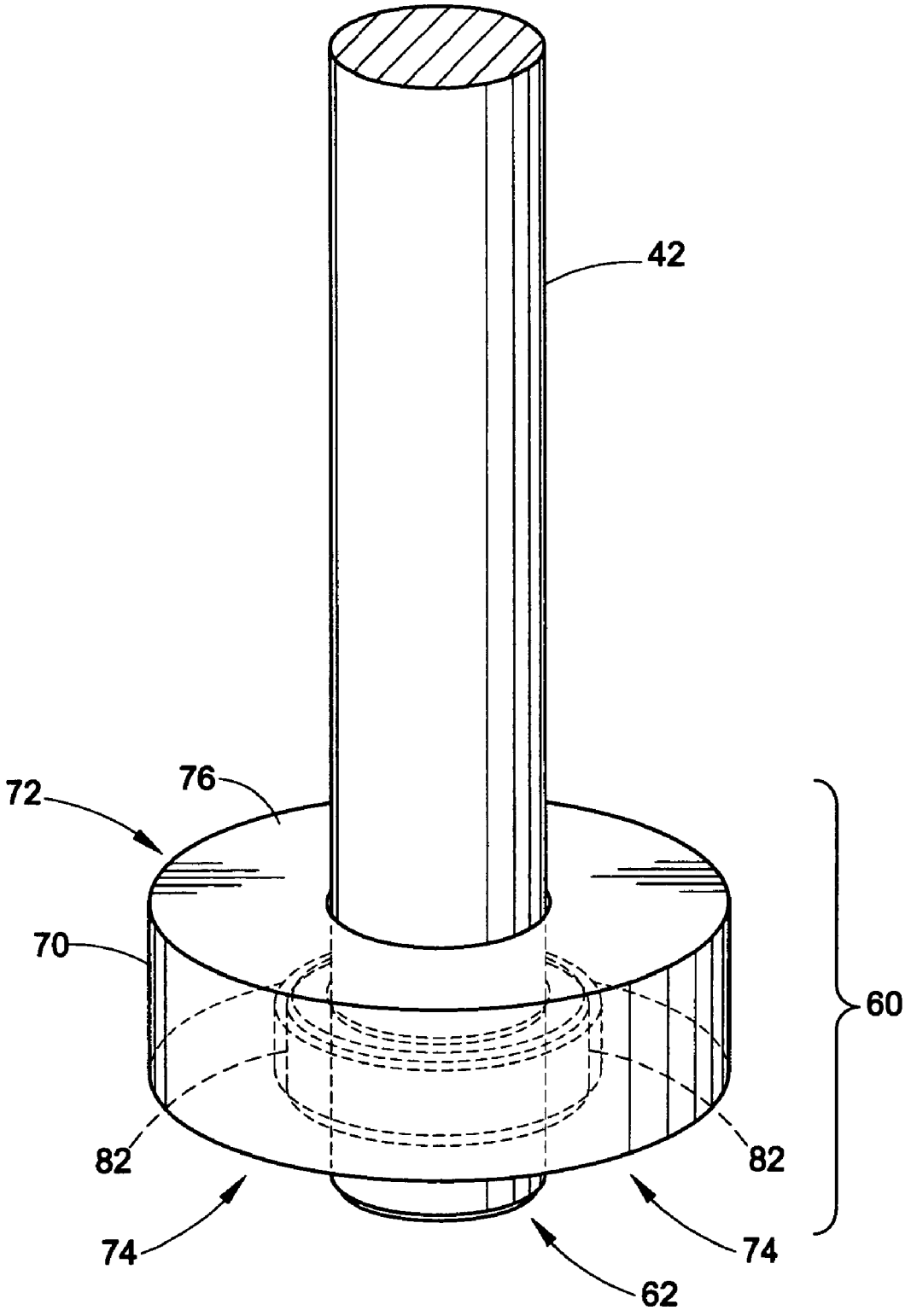
FIG. 3 is a perspective view of a rod assembly.
Figure 4:
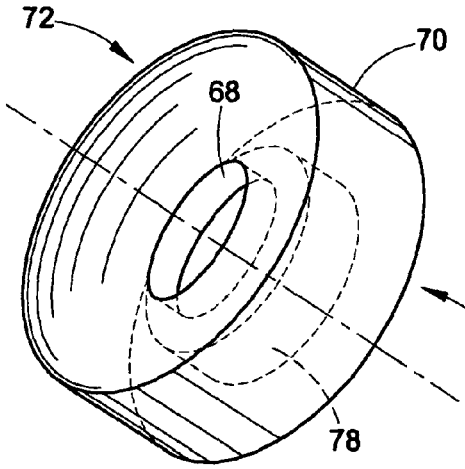
FIG. 4 is a perspective view of a tensor rod retainer cup.
Figure 5:
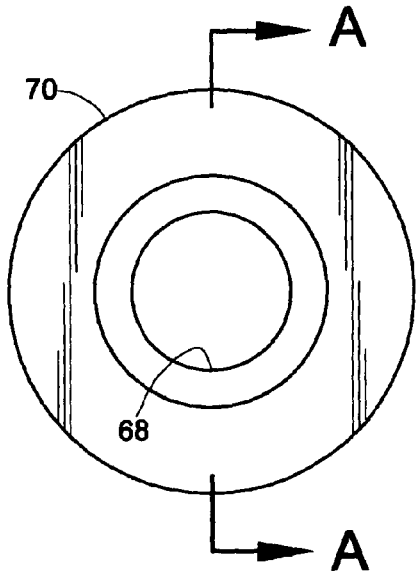
FIG. 5 is a top view of the tensor rod retainer cup.
Figure 6:
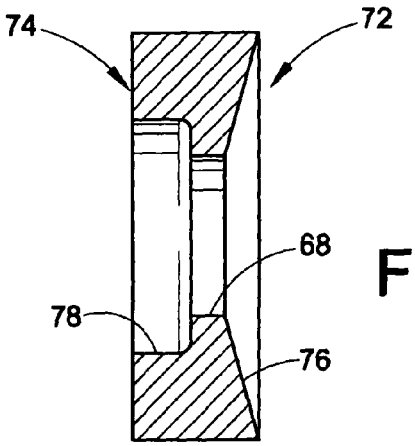
FIG. 6 is a sectional view taken along lines A-A of FIG. 4.

Referring now to FIGS. 2 and 3, a detailed depiction of a rod assembly 60 is provided. Here, the rod assembly 60 includes a rod 42, which passes through a retainer cup 70 and is kept in contact with the retainer cup 70 by the keeper pair 80, 82. As can be seen in FIGS. 4-6, the retainer cup 70 has a recess 78 on a second side 74 of the cup 70. On a first side 72 of the cup 70 is an approximately concave indentation 76. The retainer cup 70 also includes an opening 68 extending through approximately the center of the retainer cup 70.

Figure 7:
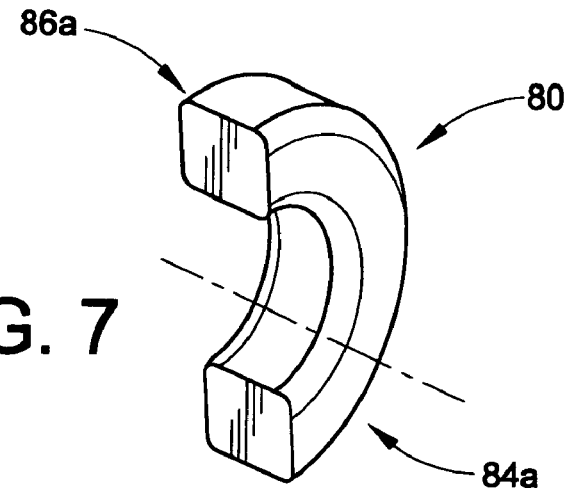
FIG. 7 is a perspective view of one half of a tensor rod keeper pair.
Figure 8:
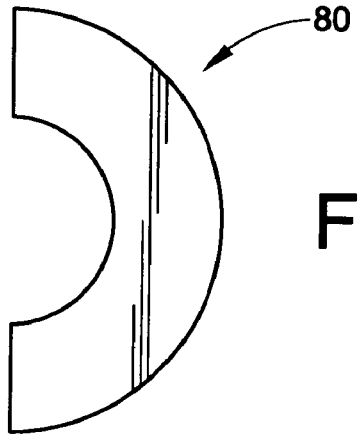
FIG. 8 is a top view of one half of the tensor rod keeper pair.
Figure 9:
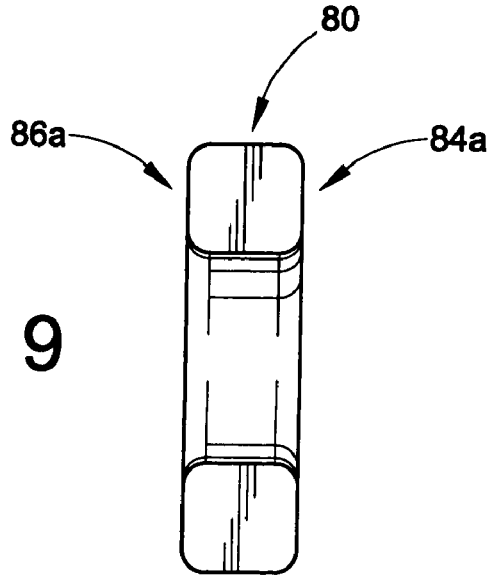
FIG. 9 is a side view of one half of the tensor rod keeper pair.
Figure 10:
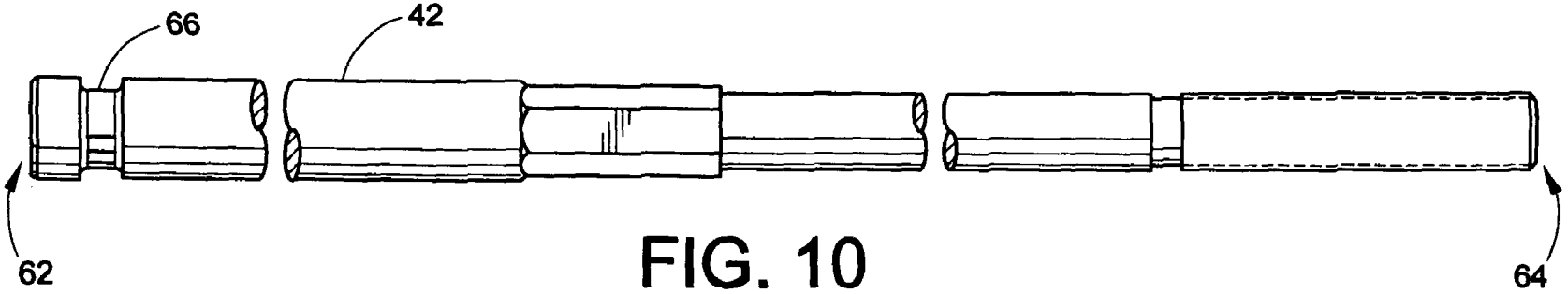
FIG. 10 is side view of a tensor rod.
Figure 11:
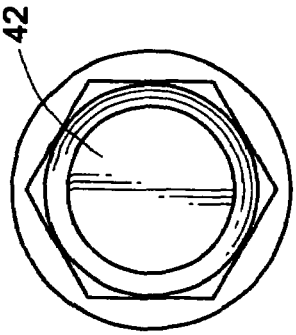
FIG. 11 is a top view of a tensor rod.

With reference to FIGS. 7-9, the keeper pair 80, 82 is illustrated. The keeper pair 80, 82 includes two halves, a first half 80 and a second half 82. The first 80 and second 82 halves are approximately mirror images of one another. The keeper pair 80, 82 includes a first side 84*a*, 84*b* and a second side 86*a*, 86*b*. Referring now to FIGS. 10 and 11, the tensor rod 42 is shown. The tensor rod 42 includes a first end 62 and a second end 64. A groove 66 in the rod 42 is disposed approximately towards the first end 62.

As illustrated by FIGS. 2 and 3, the retainer cup 70 slides down the tensor rod 42, where the first half 80 and the second half 82, i.e., the keeper pair 80, 82, come together around the tensor rod 42, essentially forming an approximate ring shape around the tensor rod 42. The keeper pair come 80, 82 together at the groove 66 located toward the first end 62 of the tensor rod 42. Once, the keeper pair 80, 82 comes together, the retainer cup 70 continues to slide down the tensor rod 42 until the recess 78 on a second side of the retainer cup 70 comes into contact with the first side 84*a*, 84*b* of the keeper pair 80, 82. The recess 78 in the retainer cup 70 then mates with the first side 84*a*, 84*b* of the keeper pair 80, 82 forming a friction fit. Now that the rod 42 is assembled 60 by having the retainer cup 70 slide onto the keeper pair 80, 82, the rod assembly 60 may be pulled in an upward direction and rotated, where the rod assembly 60 will engaged the molten metal base 12.

The above described tensor rod is equally applicable to a scrap submergence device as well as the above referenced molten metal transfer pump. In a scrap submergence system, a melting bowl can be held together by a tensor rod. U.S. Pat. No. 6,074,455 is herein incorporated by reference.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

What is claimed is:

1. A molten metal pump comprising:

a base assembly having an outlet and a pumping chamber, said pumping chamber having an impeller disposed therein;

a platform assembly spaced from said base assembly;

a motor positioned on said platform assembly;

at least one post assembly disposed between said base assembly and said platform assembly, comprising a rod disposed within a sheath, said rod having a groove;

a retaining cup having first and second sides and an opening extending therebetween, said second side including a recess;

a retaining member including at least two portions, said retaining member being received within said recess and said groove to mate said rod with said retainer cup.

2. A molten metal pump according to claim 1, wherein said motor is adapted to rotate said impeller.

3. A molten metal pump according to claim 1, further including a spring retaining said rod.

4. A molten metal pump according to claim 1, comprising at least two post assemblies.

5. A molten metal pump according to claim 1, wherein said rod is constructed of an alloy material.

6. A molten metal transfer pump according to claim 1, wherein said sheath is comprised of a ceramic material.

7. A molten metal pump according to claim 1, wherein said base assembly further includes a cavity to receive the retaining cup and a plug adapted to seal said cavity.

8. A molten metal pump according to claim 1, wherein said retaining member includes two semi-annular halves adapted to form a ring at said groove.

9. A molten metal pump according to claim 1, wherein said retainer cup is adapted to slide down said rod.

10. A molten metal pump according to claim 1, wherein said second side of said retainer cup is adapted to mate with said top side of said keeper pair and form a friction fit.

11. A post assembly for use with a molten metal pump, said assembly comprising:

a rod including a first end and a second end, a groove located adjacent the second end;

a retainer cup having a first side, a second side and an opening extending therebetween, said second side including a recess; and a keeper pair comprising at least two halves, said keeper pair being received within said recess and said groove to mate said rod with said retainer cup.

12. A post assembly according to claim 11, wherein said keeper pair halves are adapted to form a ring.

13. A post assembly according to claim 11, wherein said retainer cup is adapted to slide down said rod.

14. A post assembly according to claim 11, wherein said second side of said retainer cup is adapted to mate with said top side of said keeper pair and form a friction fit.

15. A molten metal shaft and impeller assembly comprising:

a rod including a first end and a second end;

a retainer cup having a first side, a second side and an opening extending therethough, said second side including a recess;

a keeper pair comprising two halves having a top side and a bottom side, said keeper pair being received within said recess to keep said rod in contact with said retainer cup; and an impeller including a passage accommodating said shaft and a cavity which receives said retainer cup.

* * * * *